US007059125B2

(12) United States Patent
Oka et al.

(10) Patent No.: US 7,059,125 B2
(45) Date of Patent: Jun. 13, 2006

(54) HYDRAULIC CONTROLLER FOR CONSTRUCTION MACHINE

(75) Inventors: Hidekazu Oka, Hiroshima (JP); Koji Yamashita, Hiroshima (JP); Saburo Senoo, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 31 days.

(21) Appl. No.: 10/929,959

(22) Filed: Aug. 31, 2004

(65) Prior Publication Data

US 2005/0060993 A1 Mar. 24, 2005

(30) Foreign Application Priority Data

Sep. 5, 2003 (JP) ..... 2003-314272

(51) Int. Cl.
*F16D 31/02* (2006.01)

(52) U.S. Cl. ..... 60/422; 60/445

(58) Field of Classification Search ..... 60/422, 60/445

See application file for complete search history.

(56) References Cited

U.S. PATENT DOCUMENTS

| | | | | |
|---|---|---|---|---|
| 4,586,330 | A * | 5/1986 | Watanabe et al. | 60/422 |
| 4,768,339 | A | 9/1988 | Aoyagi et al. | |
| 5,048,293 | A * | 9/1991 | Aoyagi | 60/420 |
| 5,361,211 | A | 11/1994 | Lee et al. | |
| 6,006,521 | A * | 12/1999 | Fuchita et al. | 60/422 |
| 6,050,090 | A * | 4/2000 | Tohji | 60/421 |
| 6,389,808 | B1 * | 5/2002 | Sakai | 60/422 |
| 6,393,838 | B1 * | 5/2002 | Moriya et al. | 60/422 |

FOREIGN PATENT DOCUMENTS

| | | |
|---|---|---|
| EP | 0 722 018 A1 | 7/1996 |
| JP | 53-110102 | 9/1978 |
| JP | 57-44789 | 3/1982 |
| JP | 4-143473 | 5/1982 |
| JP | 57-173533 | 10/1982 |
| JP | 62-121878 | 6/1987 |
| JP | 62-240485 | 10/1987 |
| JP | 2-129401 | 5/1990 |
| JP | 3-59227 | 3/1991 |
| JP | 4-143472 | 5/1992 |

(Continued)

*Primary Examiner*—Edward K. Look
*Assistant Examiner*—Michael Leslie
(74) *Attorney, Agent, or Firm*—Oblon, Spivak, McClelland, Maier & Neustadt, P.C.

(57) ABSTRACT

In a hydraulic controller for construction machine according to the present invention, wherein there are provided regulators for each of a first and a second capacity variable hydraulic pump, each of the regulators being controlled, detecting the discharge pressure of each pump, in such a manner that one of the pumps absorbs a part of torque while the other thereof absorbs the remaining torque, and wherein a boom raising operation causes pressure oil from the pumps to be joined together and then supplied to a boom cylinder, while also a rotating operation causes pressure oil from the second pump to be supplied to a rotating motor, is provided a flow rate distribution controller adapted to control the regulators in such a manner that a difference in flow rate is provided between the pumps so that the first pump shows a higher flow rate at the start of a combined operation of raising and rotating, and that, on a steady rotating state which results in an increase in the discharge pressure difference between the pumps, the difference in flow rate is reduced. This enables pump horsepower to be distributed optimally between the boom cylinder and rotating motor during the raising and rotating operation.

4 Claims, 6 Drawing Sheets

FOREIGN PATENT DOCUMENTS

| | | |
|---|---|---|
| JP | 6-58263 | 3/1994 |
| JP | 7-27106 | 1/1995 |
| JP | 7-189914 | 7/1995 |
| JP | 7-259140 | 10/1995 |
| JP | 9-317652 | 12/1997 |
| JP | 10-159807 | 6/1998 |
| JP | 2000-314404 | 11/2000 |
| JP | 2000-329071 | 11/2000 |
| JP | 2001-248186 | 9/2001 |
| WO | WO 00/71899 A1 | 11/2000 |

* cited by examiner

HIGHER-LEVEL SELECTION BETWEEN BOOM RAISING PILOT PRESSURE AND ROTATING PILOT PRESSURE

PRESSURE DIFFERENCE BETWEEN P1 AND P2

BOOM CYLINDER HOLDING PRESSURE

HYDRAULIC CONTROLLER FOR CONSTRUCTION MACHINE

BACKGROUND OF THE INVENTION

1. Field of the Invention

The present invention relates to a hydraulic controller for a construction machine such as a hydraulic excavator.

2. Description of the Related Art

In hydraulic excavator comprising two series of variable capacity pumps and regulators for each thereof, engine overload is prevented not only by changing the flow rate of the first pump according to the load thereon but also by detecting the load on the second pump, operating the pumps in accordance with each other, and then controlling the total horsepower of the pumps.

There are two cases: the first where working oil from each pump is supplied to each of actuators arranged respectively in two hydraulic systems, and the second where working oil from both pumps is joined together to be supplied such as in the case of a combined operation of the actuators, one case of which being selected appropriately according to actuators to be driven.

To be more concrete, in the case of a raising and rotating operation, the rotation side is supplied with only pressure oil from the second pump, while a boom cylinder is supplied with pressure oil from both pumps.

In the case of a raising and rotating operation, although in the beginning discharge oil from the pumps flows preferentially to the boom cylinder according to load balance, as the rotation comes to a steady state, oil is found to flow only to the rotation side having a lower load thereon. Consequently, due to a shortage of boom raising speed, operators operate a lever, while adjusting so as to match the horsepower of the pumps, to synchronize boom raising speed with rotating speed.

In this case, since the operating speed of multiple actuators cannot be increased at the same time, actuators with higher speeds are to be operated in accordance with the operation of an actuator with the lower speed. Thus, the engine horsepower cannot be fully utilized, resulting in a delay in working cycle time and therefore poor workability.

SUMMARY OF THE INVENTION

Accordingly, an object of the present invention is to provide a hydraulic controller for construction machine that enables synchronization between boom raising speed and rotating speed during a raising and rotating operation by distributing discharge oil from pumps optimally between a boom cylinder and a rotating motor.

The hydraulic controller for construction machine according to the present invention has the following basic constitution.

That is, the hydraulic controller for construction machine of the present invention comprises a first and a second pump as variable capacity hydraulic pump and regulators provided in each of the first and second pumps to adjust a discharge flow rate of each pump, the regulators being controlled in such a manner that one of the pumps absorbs a part of torque while the other thereof absorbs the remainder of the torque. In addition, the hydraulic controller comprises a boom cylinder for driving a boom, a rotating motor for rotating an upper rotating body of the construction machine, a boom raising detection means for detecting a boom raising operation, and a rotation detection means for detecting a rotating operation of the upper rotating body, the boom raising operation causing pressure oil from the first and second pumps to be joined together and then supplied to the boom cylinder, while also the rotating operation causing pressure oil from the second pump to be supplied to the rotating motor. Further, the hydraulic controller also comprises a first pump pressure detection means for detecting a discharge pressure of the first pump, a second pump pressure detection means for detecting a discharge pressure of the second pump, and a flow rate distribution controller for controlling a flow rate distribution between the first and second pumps. The flow rate distribution controller is adapted to control the regulators, in case of a combined operation of boom raising and rotating (a simultaneous operation of boom raising and rotating, what is called, raising and rotating operation) detected by the boom raise detection means and the rotation detection means, in such a manner that a difference in discharge flow rate between the pumps is provided at the start of the combined operation so that the first pump has a higher discharge flow rate than the second pump, and that then on a steady rotating state of the upper rotating body with a difference in discharge pressure between the pumps to be a predetermined value or more, the difference in discharge flow rate is provided to be reduced.

In accordance with the present invention, at the start of the combined operation of boom raising and rotating, the discharge flow rate of the first pump becomes higher by a predetermined amount whereby discharge oil is supplied preferentially to the boom, which allows an increase in the operation speed of the boom. When the rotation has reached the steady rotating state, a rotational working pressure decreases and there occurs a pressure difference from the boom working pressure. As this pressure difference increases, the difference in discharge flow rate decreases, and when the boom has reached a predetermined height by the boom raising operation, discharge oil is supplied (distributed) preferentially to the rotation side. Therefore, it is possible to distribute discharge oil from the pumps optimally between the boom cylinder and the rotating motor during the raising and rotating operation, which enables synchronization between boom raising speed and rotating speed.

In the present invention, it is preferable to include an arm detection means for detecting an arm operation and to have a configuration in which an arm cylinder is provided on the side of the second pump. In case the arm operation is detected by the arm detection means, the flow rate distribution controller can be adapted to reduce the difference in discharge flow rate, which is provided between the first and second pumps, according to the arm operation amount detected.

Also in the present invention, it is preferable to include a boom holding pressure detection means for detecting a holding pressure of the boom cylinder and to adapt the flow rate distribution controller to adjust the difference in discharge flow rate according to the holding pressure detected by the boom holding pressure detection means.

In this case, the boom can be controlled to the same height for the same rotating position even in the case of both a heavy load and in contrast a light load on the boom.

DESCRIPTION OF THE PREFERRED EMBODIMENTS

Figure 1:
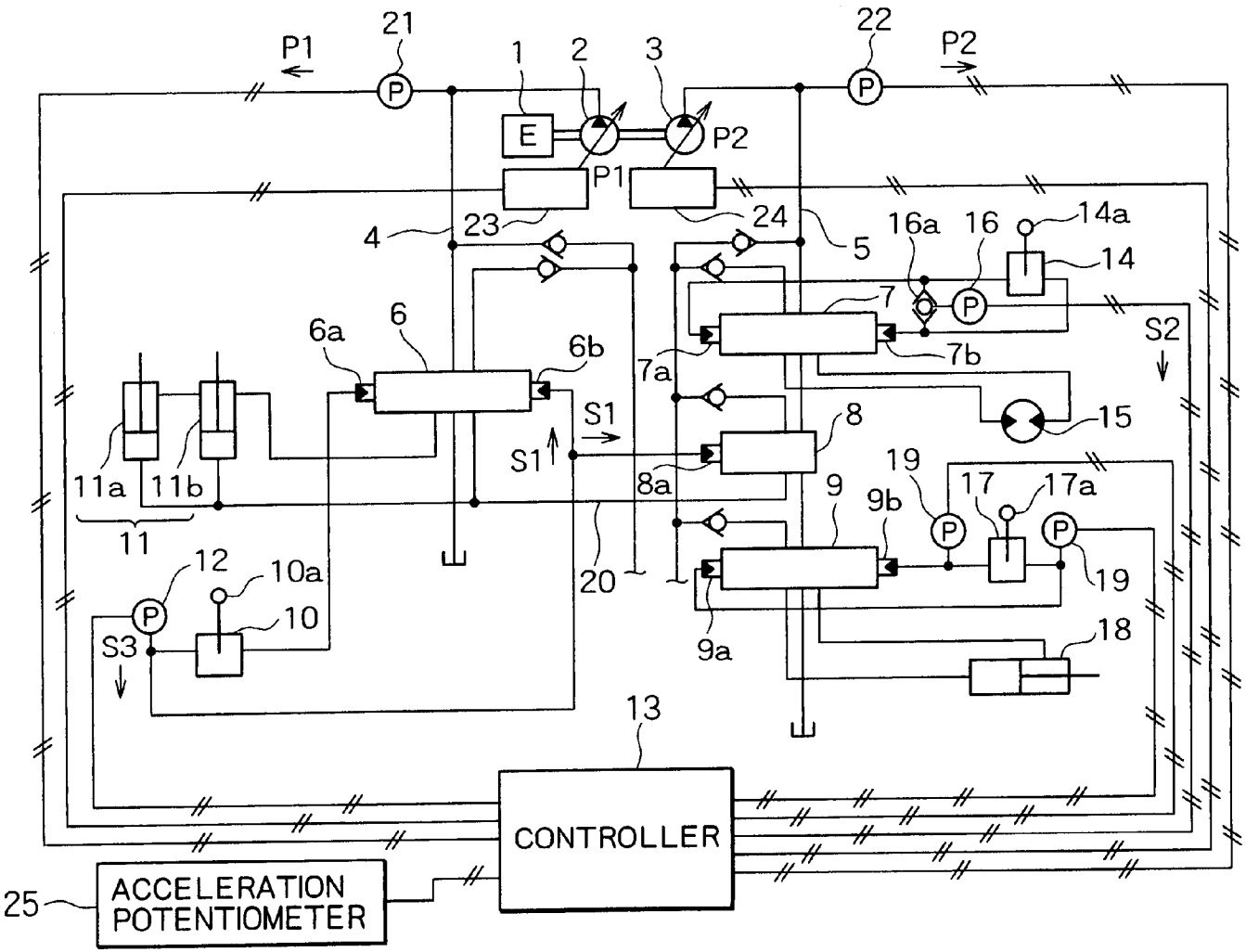
FIG. 1 is a hydraulic pressure control circuit for construction machine according to the present invention.

The present invention is directed to a hydraulic pressure control circuit for construction machine, wherein there are provided regulators for each of the first and second pumps of two series of variable capacity hydraulic pumps, each of the regulators being controlled, detecting a discharge pressure of each pump, in such a manner that one of the pumps absorbs a part of torque while the other thereof absorbs the remaining torque, and wherein a boom raising operation causes pressure oil from the first and second pumps to be joined together and then supplied to a boom cylinder, while also a rotating operation of an upper rotating body as rotating body causes pressure oil from the second pump to be supplied to a rotating motor, the hydraulic pressure control circuit comprising a boom raise detection means for detecting a boom raising operation, a rotation detection means for detecting a rotating operation, a first pump pressure detection means for detecting a discharge pressure of the first pump, a second pump pressure detection means for detecting a discharge pressure of the second pump, and a flow rate distribution controller for controlling the flow rate distribution between the first and second pumps, the flow rate distribution controller being adapted to control the regulators, in case of a combined operation of boom raising and rotating detected by the boom raise detection means and the rotation detection means, in such a manner that the first pump shows a discharge flow rate which is a certain amount higher than that of the second pump at the start of the combined operation, and that when rotation of the upper rotating body has reached a steady state, which results in an increase in the discharge pressure difference between the pumps detected by the first pump pressure detection means and the second pump pressure detection means, the difference in discharge flow rate is reduced.

The present invention will hereinafter be described in detail based on embodiments shown in the drawings.

FIG. 1 shows one embodiment in which a pump controller as a hydraulic pressure control circuit according to the present invention is applied to a hydraulic excavator.

In this figure, a first hydraulic pump 2 and a second hydraulic pump 3 are driven by driving an engine 1. The hydraulic pumps 2 and 3 are variable capacity types adapted so that the discharge flow rate varies depending on the tilting angle of swash plates.

Pressure oil discharged from the first hydraulic pump 2 is supplied to a directional control valve arranged in a central bypass line 4 on the left side of the figure. Meanwhile, pressure oil discharged from the second hydraulic pump 3 is supplied to a directional control valve arranged in a central bypass line 5 on the right side of the figure.

It is noted that although a boom, an arm and a bucket are exemplified as front attachments, the central bypass line 4 is commonly connected with a boom directional control valve 6, a bucket directional control valve, etc. Illustrated in the present embodiment is only the boom directional control valve 6 to simplify an explanation. Also in the central bypass line 5 is illustrated only a rotating direction control valve 7, a boom joint valve 8, and an arm directional control valve 9 for the same reason above.

Pilot pressure generated by operating a control lever 10*a* of a boom remote control valve 10 acts on pilot ports 6*a* and 6*b* provided, respectively, on the left and right side of the boom directional control valve 6. Pressure oil, the flow rate and direction of which being controlled by the boom directional control valve 6, is supplied to a pair of boom cylinders 11*a* and 11*b* provided in the front attachment not shown in the figure. It is noted that the numeral 12 indicates a boom raising operation sensor (boom raise detection means) for detecting an operation pressure in a boom raising operation.

Boom raising operation pressure detected by the boom raising operation sensor 12 is given to a controller 13 to be described hereinafter.

On the contrary, pilot pressure generated by operating a control lever 14*a* of a rotation remote control valve 14 acts on pilot ports 7*a* and 7*b* provided, respectively, on the left and right side of the rotating direction control valve 7. Pressure oil controlled by the control valve 7 is supplied to a rotating motor 15 for rotating an upper rotating body not shown in the figure. It is noted that the numeral 16 indicates a rotating operation sensor (rotation detection means) for detecting a right or a left rotating operation pressure generated from the rotation remote control valve 14. Rotating operation pressure detected by the rotating operation sensor 16 is given to the controller 13. It is noted that the numeral 16*a* in the figure indicates a shuttle valve for making a higher-level selection between right and left rotating operation pressures, namely for selection of a higher-pressure between them.

Pilot pressure generated by operating a control lever 17*a* of an arm remote control valve 17 acts on pilot ports 9*a* and 9*b* provided, respectively, on the left and right side of the arm rotational control valve 9. Pressure oil controlled by the control valve 9 is supplied to an arm cylinder 18 for swinging the arm among the front attachments upward and downward.

It is noted that the numerals 19 and 19 indicate arm operation sensors (arm detection means) for detecting an arm raising or lowering operation pressure generated from the arm remote control valve 17. Arm operation pressure detected by the sensors 19 is given to the controller 13.

The boom joint valve 8 increases the speed of boom raising operation. When a boom raising pilot pressure S1 generated from the boom remote control valve 10 is given in a branching manner to a port 8*a* of the joint valve 8, a part of the pressure oil from the second hydraulic pump 3 is supplied to the boom cylinders 11*a* and 11*b* through a joint oil passage 20.

Also, the numeral 21 indicates a first pump pressure sensor (first pump pressure detection means) for detecting a pump pressure P1 of the first hydraulic pump 2, while the numeral 22 indicates a second pump pressure sensor (second pump pressure detection means) for detecting a pump pressure P2 of the second hydraulic pump 3. The detection results are given to the controller 13, respectively.

The numerals 23 and 24 indicate regulators that are controlled by the controller 13. Each of the pump pressure detected by the sensors 21 and 22 is fed back through the controller 13, the regulators 23 and 24 adjusting the tilting angle of the pumps to increase or decrease a pump flow rate thereof.

Figure 2:
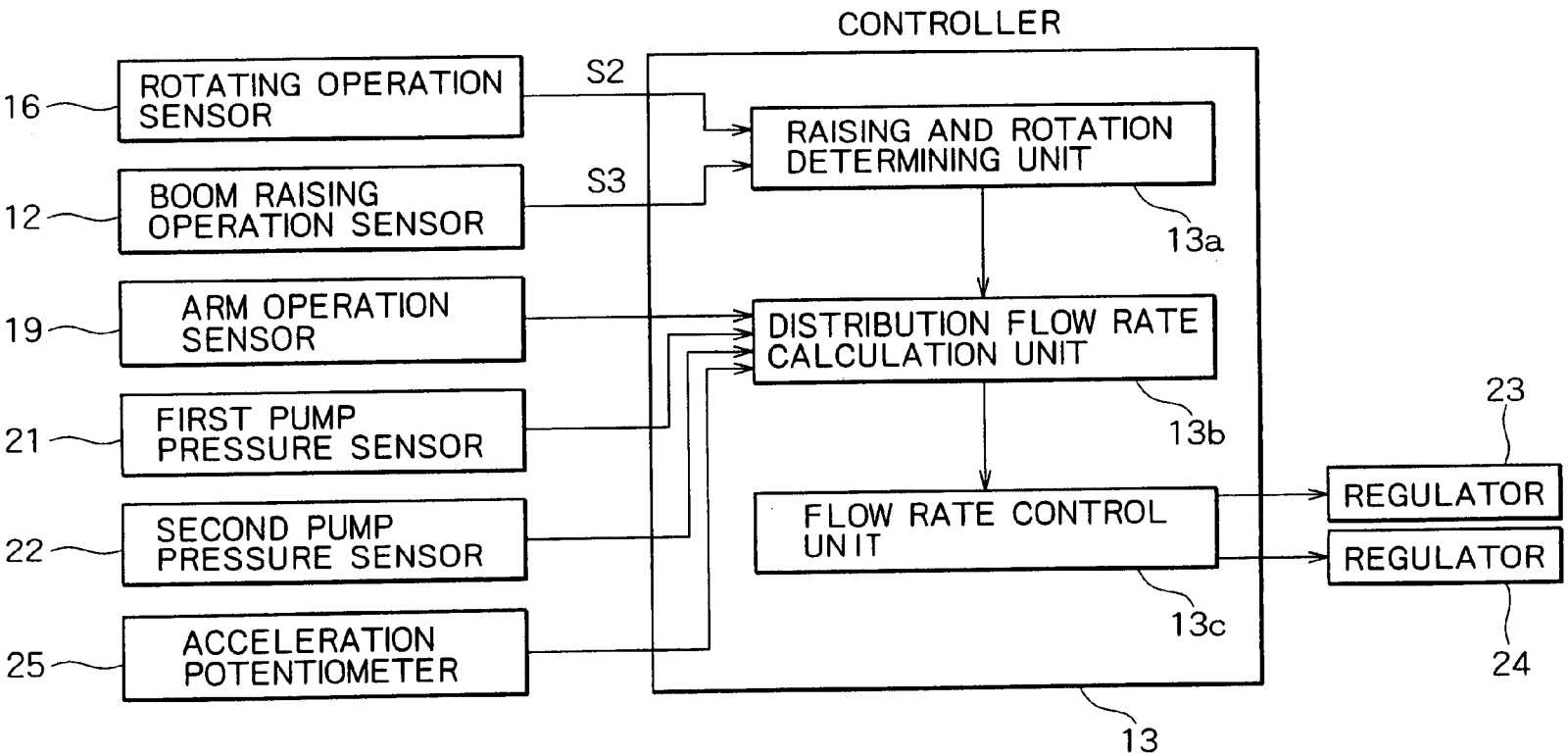
FIG. 2 is a block diagram showing input and output equipment connected to the controller shown in FIG. 1.

FIG. 2 is a block diagram showing input and output equipment connected to the controller 13.

On the input side of the controller 13 are connected with sensors 16, 12, 19, 20, 21 and 22, and an accelerator potentiometer 25, while on the output side are connected with the regulators 23 and 24.

In this figure, when an operator performs a simultaneous operation (combined operation) of rotating and boom raising, a rotating operation signal S2 is output from the rotating operation sensor 16 that detects a rotating operation pressure, and a boom operation signal S3 is also output from the boom raising operation sensor 12 that detects a boom operation pressure, each of the signals being given to the controller 13.

A raise and rotation determining unit 13*a* of the controller 13 determines whether or not both of the signals S2 and S3 are input to recognize the boom raising and rotation.

When the boom raising and rotation is recognized, a distribution flow rate calculation unit 13*b* calculates the optimal distribution of the pump flow rate between the first hydraulic pump 2 and the second hydraulic pump 3. It is noted that the distribution flow rate calculation unit 13*b* and a flow rate control unit 13*c* to be described hereinafter operate as the flow rate distribution controller.

Next, pump flow rate control by the controller 13 will be explained.

The major flow of a pump flow rate control according to the present embodiment will be explained. At the start of the raising and rotating operation, a difference in flow rate is provided so that the first hydraulic pump 2 shows a flow rate higher than that of the second hydraulic pump 3, whereby the discharge flow rate is distributed preferentially to the boom, resulting in an increase in the operation speed of the boom. Then, when the rotation has reached a steady rotating state and as the working pressure is getting reduced, the control for providing the difference in the flow rate is released (the difference in flow rate is provided to be reduced when having reached a predetermined value or more), and the rotating speed after the boom raising operation is controlled to be higher.

Figure 3:
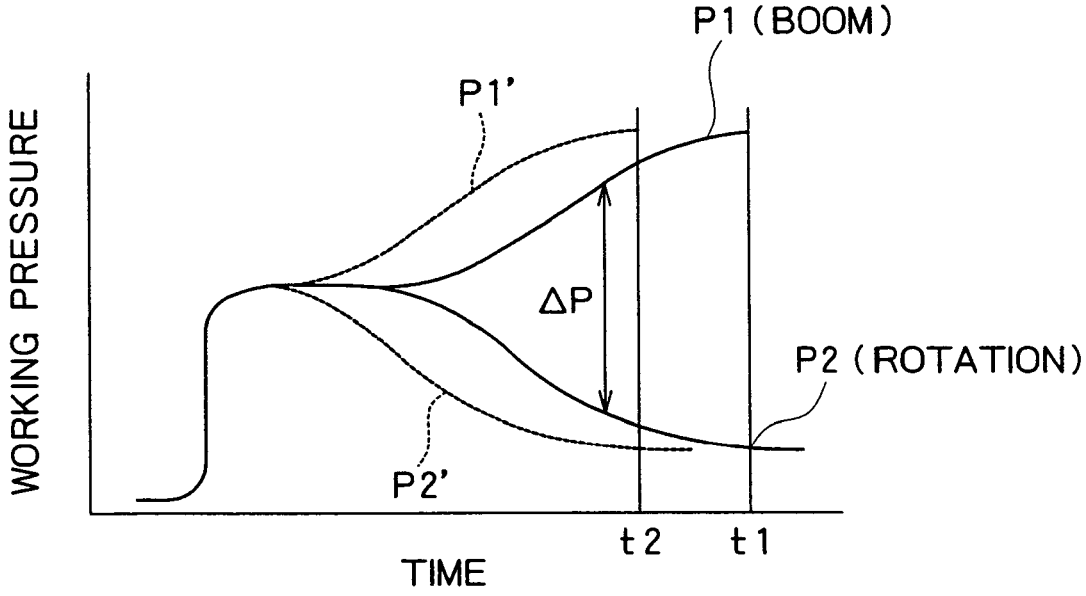
FIG. 3 is a graph showing the characteristics of boon working pressure and rotational working pressure in a raising and rotating operation.

FIG. 3 shows a comparison between a prior art example and the present embodiment about the characteristics of boom working pressure and rotational working pressure in a raising and rotating operation.

In this figure, P1 and P2 are characteristics, respectively, of boom working pressure and rotational working pressure in the prior art example in the case the pump flow rate is distributed at 50:50, while also P1' and P2' are characteristics, respectively, of boom working pressure and rotational working pressure in the present embodiment.

In the pump control of the prior art example, a boom joint operation performs a boom raising and rotating operations at the start of a raising and rotating operation, causing P1 and P2 to show the same pressure, as shown in the figure. Subsequently, as the rotating operation is getting stabilized, the rotational working pressure P2 is reduced, and therefore, there occurs a pressure difference ΔP between P1 and P2, thus the boom reaches the stroke end at time t1.

Meanwhile, in the pump control of the present embodiment, the discharge flow rate of the first pump 2 is controlled in such a manner as to be a certain amount higher than that of the second pump 3 at the start of a combined operation of boom raising and rotating. This causes the boom to reach the stroke end at time t2 <t1, which allows shortage of boom raising speed to be resolved. Also, when the rotation has reached a steady rotating state, which causes the discharge pressure difference between the pumps to be increased, the difference in discharge flow rate is controlled to be reduced, whereby the rotational working pressure P2 does not decrease more than necessary with no possibility of cavitations.

Figure 4:
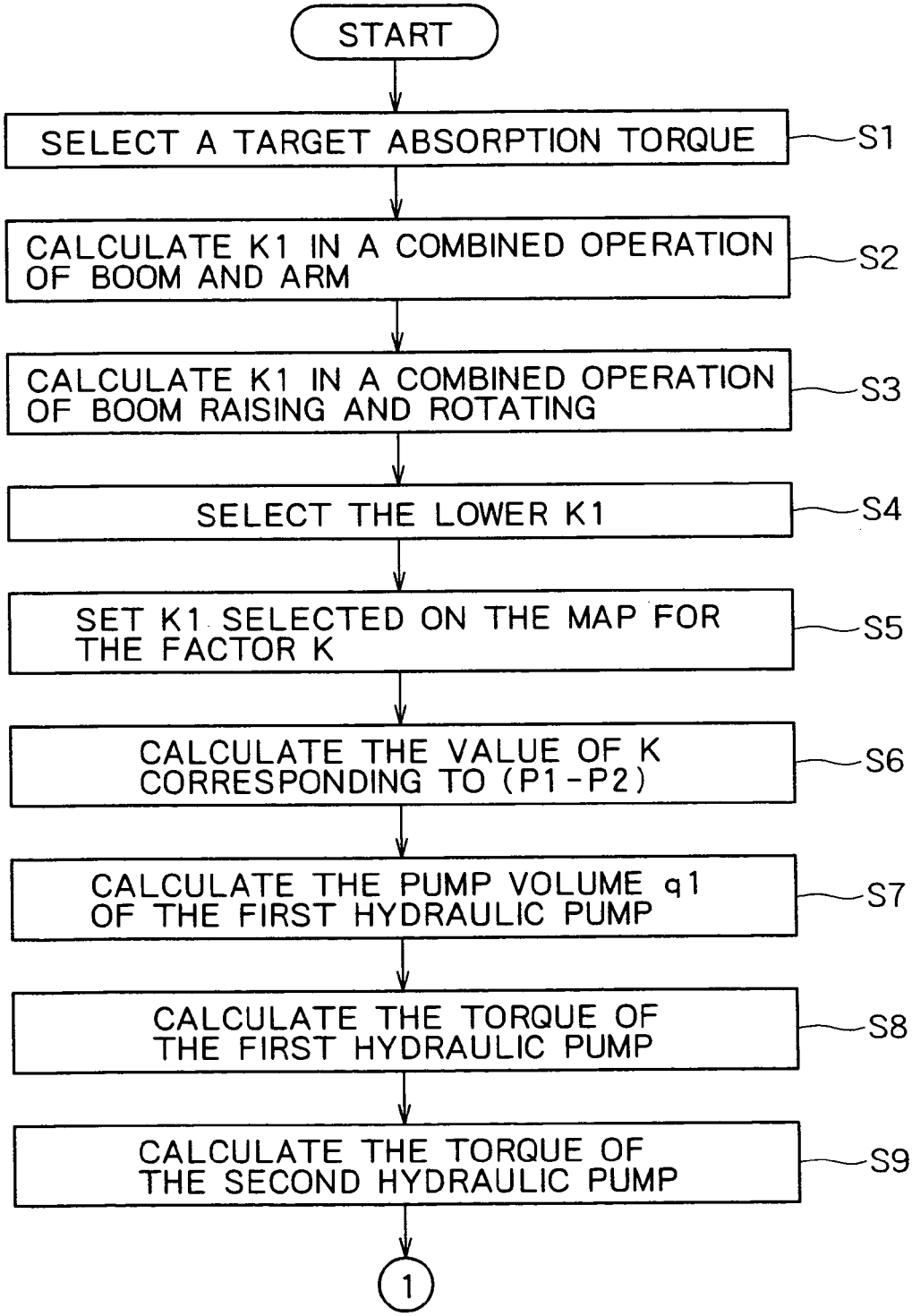
FIG. 4 is a flowchart showing a pump control operation according to the present invention.
Figure 5:
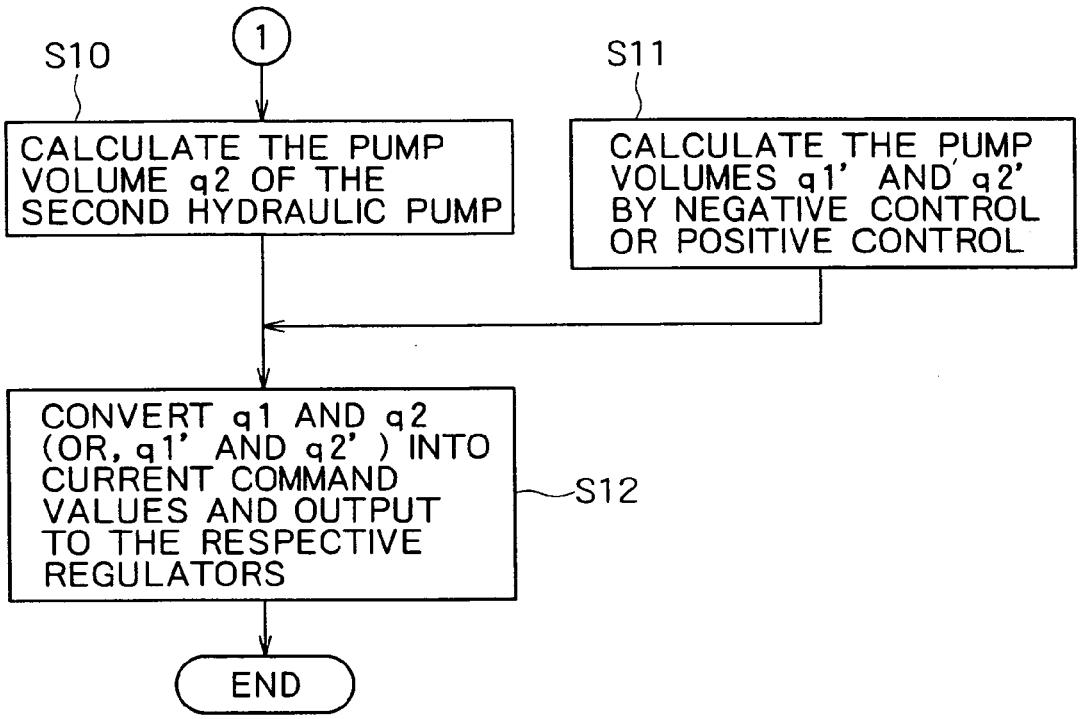
FIG. 5 is a flowchart showing a pump control operation according to the present invention.

The pump flow rate control of the present embodiment will hereinafter be described in accordance with the flowcharts shown in FIGS. 4 and 5.

First, based on a target revolution number set by the acceleration potentiometer 25, a target absorption torque T is selected referring to a revolution-torque table (step S1).

In case of a combined operation of boom raising and rotating, it is necessary to put a flow rate according to an operation amount of the arm from the side of the first pump 2 back to the side of the second pump 3. Therefore, a map with a horizontal and a vertical shaft shall have been arranged preliminarily, with the horizontal shaft representing the difference between boom raising operation pressure and arm pulling operation pressure, and the vertical shaft representing a factor K1, wherein the factor K1 becomes smaller when the arm is operated deeply.

It is noted that the factor K1 shows the upper limit of a factor K that is used for a pump volume calculating formula to be described hereinafter.

The factor K1 is calculated based on this map when the arm is operated (step S2).

Figure 7:
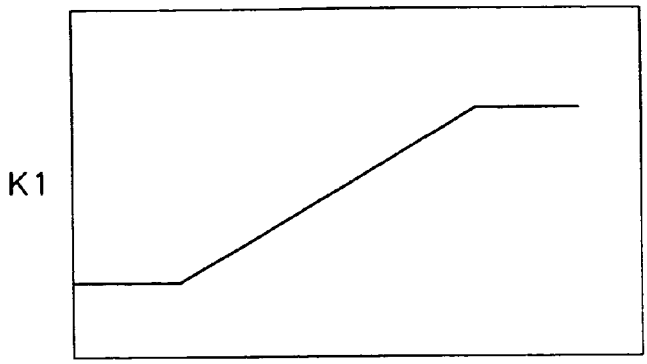
FIG. 7 is a map showing a factor K1 in a combined operation of boom raising and rotating.

Next, in the case of a combined operation of boom raising and rotating, the factor K1 in combined operation of boom raising and rotating shown in FIG. 7 is calculated (step S3).

The map for the factor K1 shown in FIG. 7 is arranged in such a manner that as the boom raising operation pressure or the rotating operation pressure is increased, the factor K1 becomes larger, that is, the difference in flow rate becomes larger.

Figure 6:
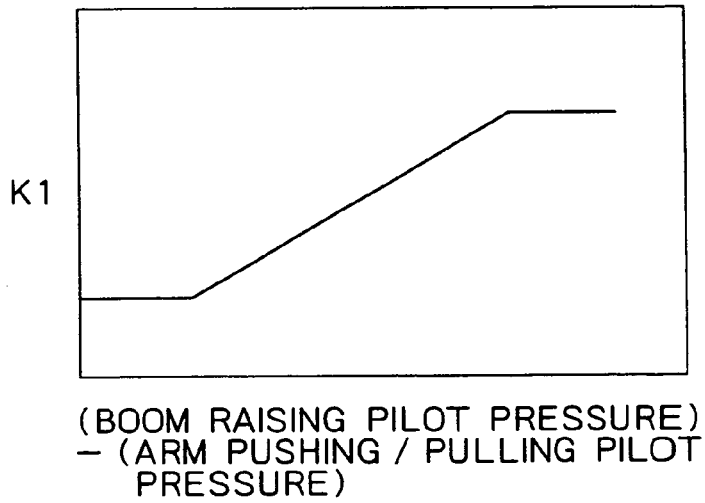
FIG. 6 is a map showing a factor K1 in a combined operation of boom and arm.

Then, a lower-level selection between the factor K1 calculated based on the map in FIG. 6 and the factor K1 calculated based on the map in FIG. 7 is made (step S4). Next, the factor K1 selected is set as the upper limit K1 of the map shown in FIG. 8 (step S5).

Figure 8:
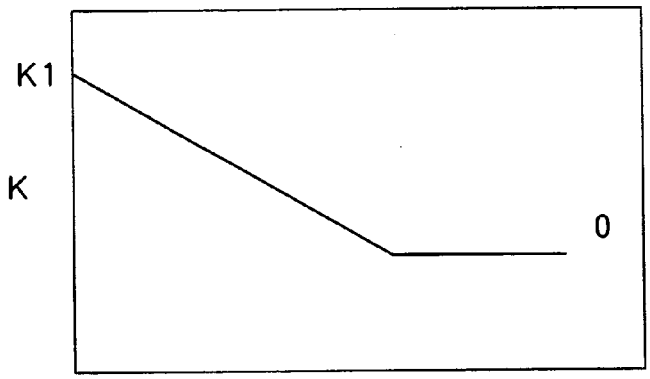
FIG. 8 is a map showing a factor K for finding the difference in flow rate between a first and a second hydraulic pump.

In FIG. 8, the horizontal shaft represents the pump pressure difference (P1−P2) between the first hydraulic pump 2 and the second hydraulic pump 3, while the vertical shaft represents a factor K. The upper limit K1 of the factor in case of a pressure difference of zero is the K1 selected in either step S2 or S3.

Next, the factor K in the pressure difference between P1 and P2 is calculated based on the map of the figure (step S6).

The factor K calculated above is assigned to the following formula (1) to find the pump volume (step S7).

$$q1=(2\pi T/P1+P2)\times K \tag{1}$$

where q1 indicates the pump volume (capacity) of the first hydraulic pump 2.

And then, the torque T1, which the first hydraulic pump 2 requires, is calculated with the following formula (2) (step S8):

$$T1=q1\ P1/2\pi \tag{2}$$

Next, the torque T2 to be distributed from the absorption torque T1 to the second hydraulic pump 3 is calculated with the following formula (3) (step S9):

$$T2=T-T1 \quad (3)$$

Then, the pump volume q2 of the second hydraulic pump 3 is calculated with the following formula (4) (step S10):

$$q2=2\pi T2/P2 \quad (4)$$

The flow rate control unit 13*c* converts q1 and q2 found as above into current command values and outputs, respectively, to the regulators 23 and 24 (step S12).

It is noted that the controller 13 calculates the pump volumes q1' and q2' by negative control or positive control, as is the case with prior art pump control (step S11). In step S12, the higher ones of either the pump volumes q1 and q2 calculated with formulae (1) to (4) or the pump volumes q1' and q2' above are selected and then output, respectively, to the regulators 23 and 24.

Also, to comprise an adjustment means that allows operators to manually operate the difference in flow rate above can actualize operationality favorable for the respective operators. In the present embodiment, operators may arbitrarily adjust the value of the K1 above by operating, for example, a dial switch.

Figure 9:
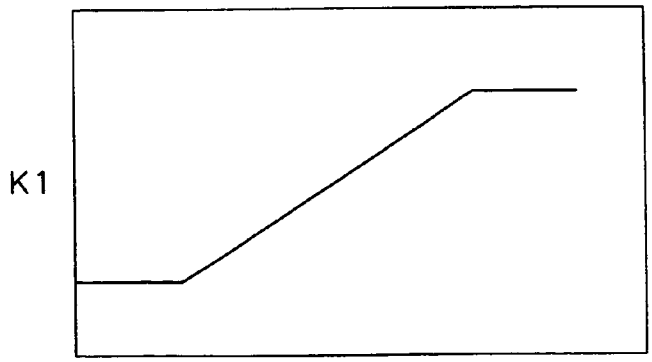
FIG. 9 is a map showing a factor K1 according to boom cylinder holding pressure.

Further, to detect a holding pressure of the boom cylinder and to change the value of the K1 as shown in FIG. 9 according to the holding pressure detected enables the boom to be controlled to the same height for the same rotating position even in case of both a heavy load and in contrast a light load on the boom.

Although raising and rotating operations in case the boom raising or rotating is even faster than the other are evaluated to have poor operationality, in accordance with the present invention, it is possible to actualize a situation where the boom is found to be raised smoothly to the height of the truck bed when, for example, rotating by 90 degrees in a dump operation.

Although the invention has been described with reference to the preferred embodiments in the attached figures, it is noted that equivalents may be employed and substitutions made herein without departing from the scope of the invention as recited in the claims.

We claim:

1. A hydraulic controller for construction machine, comprising:

a first and a second pump as variable capacity hydraulic pump;

regulators provided in each of said first and second pumps to adjust a discharge flow rate of each of said pumps, said regulators being controlled in such a manner that one of said pumps absorbs a part of torque while the other thereof absorbs the remainder of the torque;

a boom cylinder for driving a boom;

a rotating motor for rotating an upper rotating body of the construction machine;

a boom raising detection means for detecting a boom raising operation, said boom raising operation causing pressure oil from said first and second pumps to be joined together and then supplied to said boom cylinder;

a rotation detection means for detecting a rotating operation of said upper rotating body, said rotating operation causing pressure oil from said second pump to be supplied to said rotating motor;

a first pump pressure detection means for detecting a discharge pressure of said first pump;

a second pump pressure detection means for detecting a discharge pressure of said second pump; and a flow rate distribution controller for controlling a flow rate distribution between said first and second pumps, said flow rate distribution controller being adapted to control said regulators, in case of a combined operation of boom raising and rotating detected by said boom raising detection means and said rotation detection means, in such a manner that a difference in discharge flow rate between said pumps is provided at the start of said combined operation so that said first pump has a higher discharge flow rate than said second pump, and then, on a steady rotating state of said upper rotating body with a difference in discharge pressure between said pumps to be a predetermined value or more, said difference in discharge flow rate is provided to be reduced.

2. The hydraulic controller for construction machine according to claim 1, further comprising:

an arm detection means for detecting an arm operation, wherein an arm cylinder is provided on the side of said second pump and, in case said arm operation is detected by said arm detection means, said flow rate distribution controller reduces said difference in discharge flow rate between said pumps according to an amount of the arm operation detected.

3. The hydraulic controller for construction machine according to claim 1, further comprising:

an adjustment means for adjusting said difference in discharge flow rate.

4. The hydraulic controller for construction machine according to claim 1, further comprising:

a boom holding pressure detection means for detecting a holding pressure of said boom cylinder, said flow rate distribution controller being adapted to adjust said difference in discharge flow rate according to the holding pressure detected by said boom holding pressure detection means.

* * * * *